United States Patent [19]

Soecknick et al.

[11] 4,195,490

[45] Apr. 1, 1980

[54] COOLING TUNNEL FOR COOLING A CONTINUOUSLY RUNNING BELT

[75] Inventors: Erhard Soecknick; Gerhard von Hoesslin, both of Düsseldorf, Fed. Rep. of Germany

[73] Assignee: Messer Griesheim GmbH, Frankfurt am Main, Fed. Rep. of Germany

[21] Appl. No.: 925,869

[22] Filed: Jul. 18, 1978

[30] Foreign Application Priority Data

Jul. 23, 1977 [DE] Fed. Rep. of Germany ..... 2733418

[51] Int. Cl.[2] ..... F25D 17/02

[52] U.S. Cl. ..... 62/374; 62/380

[58] Field of Search ..... 62/63, 266, 345, 374, 62/375, 380

[56] References Cited

U.S. PATENT DOCUMENTS

| | | | |
|---|---|---|---|
| 3,427,820 | 2/1969 | Hart | 62/374 |
| 3,611,737 | 10/1971 | Alaburda et al. | 62/374 |
| 3,881,322 | 5/1975 | LeDiouron | 62/63 |
| 4,075,869 | 2/1978 | Fitsall | 62/380 |

*Primary Examiner*—Ronald C. Capossela

*Attorney, Agent, or Firm*—Connolly and Hutz

[57] ABSTRACT

A cooling tunnel for cooling a continuously running belt or partial belt section by means of a low boiling liquefied gas to a predetermined temperature has its cover in the form of a chamber which has a connection near the tunnel entrance for supplying the liquid cooling agent and a connection near the tunnel exit for discharging evaporated cooling agent with at least one pipeline for returning the evaporated cooling agent to the cooling tunnel.

10 Claims, 2 Drawing Figures

COOLING TUNNEL FOR COOLING A CONTINUOUSLY RUNNING BELT

BACKGROUND OF INVENTION

The invention relates to a cooling tunnel for cooling a continuously running belt or partial belt section by means of a low boiling liquefied gas to predetermined temperatures.

Cooling tunnels are often used for freezing products, particularly foods. These cooling tunnels consist of an insulated housing through which a transport belt runs on which the products to be frozen are located. The products are sprayed with the cooling agent, usually liquid nitrogen, during transport through the cooling tunnel.

The cooling tunnel to which the invention is directed should, however, not serve the purpose of cooling or freezing individual products, but cool a belt which runs continuously through the cooling tunnel to predetermined temperatures.

It is very often required in production processes that continuously running belts of different materials, for example, plastic or steel must have an exactly defined temperature. This defined temperature is needed for certain subsequent production processes. The cross section of these belts may be rectangular, especially plastic belts, however, can already be provided with the most different geometric shapes. Such exact temperatures are, for example, necessary when certain shaped articles are to be punched out of the belts in the subsequent production processes. When the temperatures in individual partial belt sections are then different or the temperature of the belt fluctuates temporarily, shape and fit of the punched out shaped articles is impaired. It is desirable in other subsequent production processes, on the other hand, that the temperature in the edge zones of the continuously running belt is lower than in the center.

These types of belts are often cooled with air, which is made to impinge on the belt surface from nozzles. An exact temperature for the belt can, however, not be maintained in this way, since the temperature of the belt is especially affected by the surrounding temperature. An attempt is made to eliminate this temperature effect, by increasing or decreasing the production speed corresponding to the actual belt speed. The adjusting process is, however, time consuming and cause for frequent product waste. The problems become even greater when individual partial belt sections have to be cooled to predetermined temperatures.

SUMMARY OF THE INVENTION

The invention has its object of providing a cooling tunnel for cooling a continuously running belt or a partial belt section by means of a low boiling liquefied gas to predetermined temperatures which makes an exact maintenance of the predetermined belt temperature, independent of the surrounding temperature and optionally cooling of partial belt sections possible with a high degree of accuracy.

This object is attained according to the invention when the cover of the cooling tunnel is constructed as a cooling chamber which has a connection near the tunnel entrace for the supply of the liquid cooling agent and a connection near the tunnel exit for the discharge of the evaporated cooling agent as well as at least one pipeline for the return of the evaporated cooling agent to the cooling tunnel.

The cooling chamber is preferably constructed as a slot with a low height. The evaporated cold gas flows then at high speed through the slot as a result of which the cooling effect is increased. The guides for the belt are for the same reason preferably arranged in such a way that the belt is guided at a close distance along the cooling chamber.

Especially when the evaporated gas is returned in the slot formed in this way between cooling chamber and belt, a high convection heat transfer is produced as a result of the high flow speed of the gas.

In a preferred embodiment of the cooling tunnel according to the invention, the cooling chamber consists of several parallel individual chambers with separate connections for the supply and discharge of the cooling agent. As a result, individual partial belt sections can be cooled to different temperatures. On the otherhand, a very uniform temperature distribution can also be obtained in the belt cross section in this way. If the belt edges are cooled less, for example, than the center of the belt, the individual chambers arranged near the edges of the belt can produce an increased cooling capacity by correspondingly regulating the cooling agent supply.

It is furthermore, advantageous when the cooling tunnel has such an inclination that the tunnel entrance lies lower than the tunnel exit. As a result, the separation of liquid cooling agent at the tunnel entrance from the gaseous cooling agent at the tunnel exit is facilitated.

THE DRAWINGS

FIG. 1 is a longitudinal cross-sectional view through a cooling tunnel along the line C–D in FIG. 2; and FIG. 2 is a cross sectional view through a cooling tunnel along the line A–B in FIG. 1.

DETAILED DESCRIPTION

Figure 1:
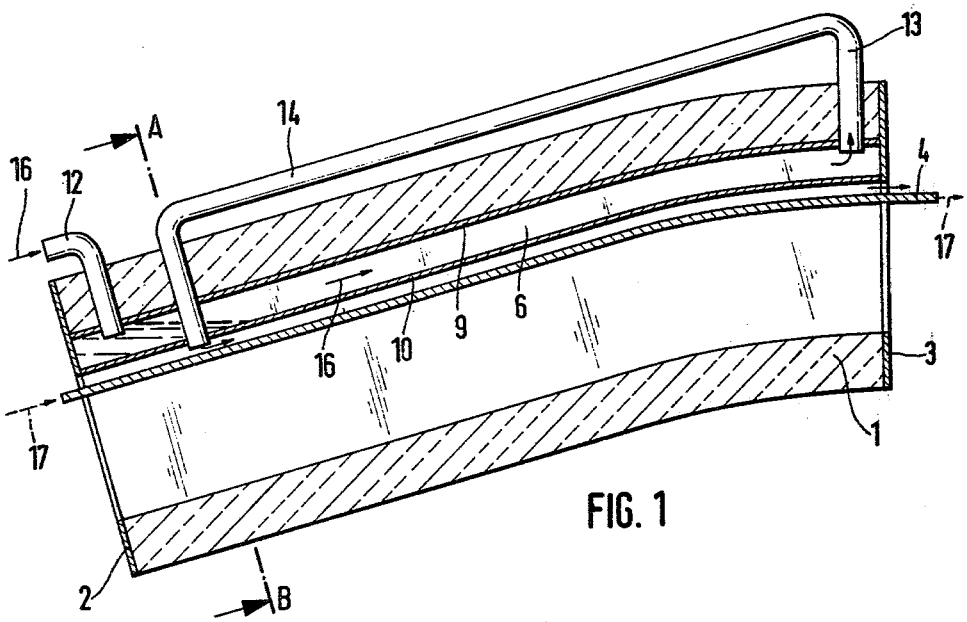
Figure 2:
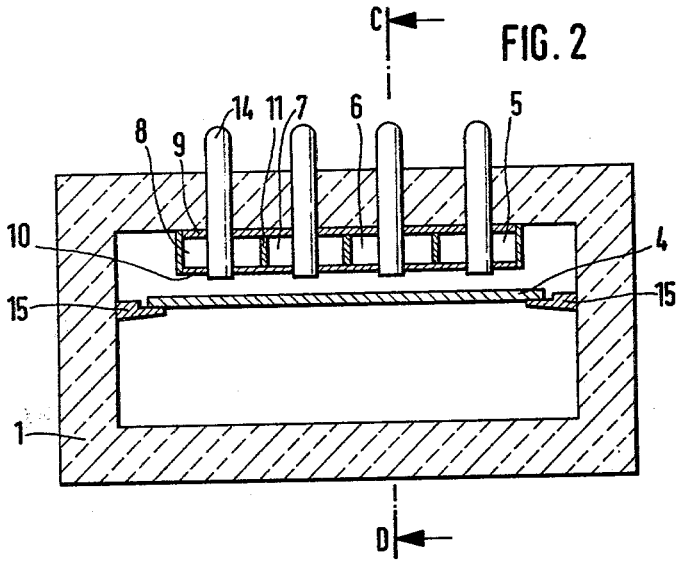

The cooling tunnel shown in FIGS. 1 and 2 consists of an insulated housing 1 with sealing baffles 2, 3 at the tunnel entrance and exit, respectively. The tunnel is inclined horizontally. The angle of inclination should be at least 7° and may be 90° in extreme cases. The cross section of the tunnel depends on the shape of belt 4 to be cooled. In the case shown, the cross section of the tunnel could also be flatter. Where belt 4 has, however, already been preprocessed and, for example, has downwardly directed indentations, a larger tunnel cross section than that illustrated is needed. As shown in the drawings, belt 4 is of non-continuous-loop or single run form.

According to the invention the cover of the cooling tunnel is hollow and constructed as cooling chambers 5, 6, 7, 8. It essentially consists of two baffles 9 and 10 which form a slot between each other. Baffle 10 is made of copper, while baffle 9 can be made of chrome-nickel steel. A total of four parallel individual chambers are formed by means of three separation strips 11. FIG. 1 shows the individual chamber 6 in cross section. Chamber 6 has a connection or inlet 12 for the supply of the liquid cooling agent, for example, nitrogen, near the tunnel entrance. Near the tunnel exit is a connection or outlet 13 for the discharge of the evaporated cooling agent. This is returned to the belt transport section of the cooling tunnel through the pipeline 14 and, to be sure, in the space between baffle 10 and belt 4. This space is constructed as a narrower slot which is produced by guides 15 which allow belt 4 to slide close beneath baffle 9.

The warm belt 4 which enters during operation the cooling tunnel causes the liquid nitrogen, supplied through connection 12, to boil. Because of the slot-shaped cross section of cooling chamber 6, the evaporated gas flows rapidly to the connection 13. It arrives in the narrow slot between baffle 9 and belt 4 through the pipeline 14. The evaporated gas may be returned to the slot between the baffle 10 and belt 4 via several openings which are arranged in different locations.

Here too, therefore, high gas speed result. This leads, in addition to the heat transfer by radiation, also to a very effective convection heat transfer which contributes as a result a substantial share to the cooling.

The cooling agent supply is regulated by a temperature sensor, not shown. Depending on the operating requirements, one temperature sensor for all chambers or one temperature sensor per chamber can be used for total control. The temperature sensors measure the gas temperature which is a characteristic value of the cooling capacity. The cooling agent supply is controlled via an actual rated value control and appropriate solenoid valves. A separate temperature control for each cooling chamber is required when a different temperature gradient is desired along the cross section of belt 4, for example, a greater amount of cooling of the edge zones. Cooling chambers 5 and 8 must produce a higher cooling capacity in this case.

FIG. 1 shows the path of the cooling agent in solid arrows 16, the direction of movement of belt 4 in dotted arrows 17.

In conclusion, the essential dimensions are indicated for a cooling tunnel according to the invention: the cooling tunnel length is about 2 m, the internal cross section is 64 cm×17 cm. The slot width of the cooling chamber (distance between baffles 9 and 10) is 3 mm. The belt to be cooled is transported below the cooling chamber at a distance of about 2 mm.

The equipment according to the invention makes cooling of the belts to a predetermined temperature, independent of the surrounding temperature, possible. Cumbersome control operations of adapting the belt speed to the appropriate belt temperature are, therefore, eliminated.

Compared to conventional cooling with air, cooling in the cooling tunnel according to the invention is also faster. In summary, a detectable increase of the production speed and a reduction of waste production is obtained as a result.

What is claimed is:

1. In a cooling tunnel for cooling a continuously running single run non-continuous-loop belt or partial belt section by means of a low boiling liquified gas as a cooling agent to a predetermined temperature wherein the tunnel includes a belt transport section with guide means for supporting the single run belt as it passes from the entrance end to the exit end of the transport section, the improvement being a hollow cover above said belt transport section, said cover being a cooling chamber for cooling the belt therebelow by radiation, an inlet in said cooling chamber near said transport section entrance, a source of low boiling liquified gas connected to said cooling chamber inlet for supplying the cooling agent to said cooling chamber whereby said cooling agent evaporates in said chamber, an outlet in said cooling chamber near said transport section exit for discharge of the evaporated cooling agent therefrom, and at least one pipeline connected to said outlet and leading to said transport section for conveying evaporated cooling agent to said transport section.

2. A cooling tunnel according to claim 1, characterized in that said cooling chamber is constructed in a slot form of narrow height.

3. A cooling tunnel according to claim 2, characterized by said guide means which guide the belt being located at a close distance to said cooling chamber to create a narrow space between the belt and said cooling chamber.

4. A cooling tunnel according to claim 3, characterized in that said pipeline for the return of the evaporated cooling agent exits in said space between the belt and said cooling chamber.

5. A cooling tunnel according to claim 4, characterized in that said cooling chamber consists of several parallel individual chambers with separate inlets and outlets for the supply and discharge of the cooling agent.

6. A cooling tunnel according to claim 5, characterized by said tunnel having an inclination with the tunnel entrance being lower than the tunnel exit.

7. A cooling tunnel according to claim 1, characterized by said guide means which guide the belt being located at a close distance to said cooling chamber to create a narrow space between the belt and said cooling chamber.

8. A cooling tunnel according to claim 7, characterized in that said pipeline for the return of the evaporated cooling agent exits in said space between the belt and said cooling chamber.

9. A cooling tunnel to claim 1, characterized in that said cooling chamber consists of several parallel individual chambers with separate inlets and outlets for the supply and discharge of the cooling agent.

10. A cooling tunnel according to claim 1, characterized by said tunnel having an inclination with the tunnel entrance being lower than the tunnel exit.

* * * * *